United States Patent [19]

DaMert

[11] 4,060,651

[45] Nov. 29, 1977

[54] METHOD FOR APPLYING STIFFENER TO COMPUTER PAPER

[76] Inventor: Frederick A. DaMert, 31 Muir Ave., Piedmont, Calif. 94610

[21] Appl. No.: 660,592

[22] Filed: Feb. 23, 1976

Related U.S. Application Data

[63] Continuation of Ser. No. 484,538, July 1, 1974, abandoned.

[51] Int. Cl.[2] ..... B05D 5/00; B05D 1/28

[52] U.S. Cl. ..... 427/285; 118/60; 118/219; 118/221; 118/222; 118/224; 118/225; 118/230; 118/411; 427/288; 427/391; 427/395; 427/428

[58] Field of Search ..... 118/60, 219, 221, 222, 118/224, 225, 230, 411; 427/285, 288, 391, 395, 428

[56] References Cited

U.S. PATENT DOCUMENTS

| | | | |
|---|---|---|---|
| 1,619,081 | 3/1927 | McLaurin | 427/286 X |
| 2,757,636 | 8/1956 | Stephens et al. | 427/286 X |
| 3,364,055 | 1/1968 | Nelson | 427/286 X |
| 3,416,943 | 12/1968 | Clark et al. | 427/286 |
| 3,658,364 | 4/1972 | DaMert | 282/12 X |

*Primary Examiner*—Michael R. Lusignan
*Attorney, Agent, or Firm*—Townsend and Townsend

[57] ABSTRACT

Stiffeners in the form of spaced, narrow bands or lines of flowable, quick-setting material are applied to one side of a moving paper web to be used as computer paper. The stiffeners are applied either immediately before or during the time the paper web is partially wrapped around a cylindrical drum so that the material will set to a solidified condition while it is on the drum to set up a molecular pattern in each stiffener line, causing the paper web to be inherently biased in one direction. Guide means is provided for directing the paper web onto and off the drum. The material may be applied by applicator guns or wheels as the paper web moves through a rotary printing press and as it moves toward a line hole punch apparatus, perforating means and a fan-folding mechanism.

6 Claims, 5 Drawing Figures

METHOD FOR APPLYING STIFFENER TO COMPUTER PAPER

This is a continuation of application Ser. No. 484,538, filed July 1, 1974, now abandoned.

This invention relates to improvements in the stiffening of paper used for computer print-out work and, more particularly, to a method and apparatus for applying spaced stiffeners to one face of a moving web of computer paper.

BACKGROUND OF THE INVENTION

In U.S. Pat. No. 3,658,364, computer print-out paper is disclosed as having a number of spaced stiffeners for the back face thereof so that the stiffeners will increase the stiffness of relatively lightweight paper. The stiffening of the paper will allow it to be moved through high-speed computer printing equipment, such as IBM 3211 and N1-1403 Printers, and emerge from the equipment and to be quickly and easily re-fan-folded into a neat stack.

Computer paper is provided with a plurality of transverse fold lines which divide the paper into sheet sections of substantially the same size. As the paper emerges from rotary printing equipment, it passes through a fan-folding mechanism which causes the paper to be folded along the fold lines and to fall onto a stack formed of superimposed sheet sections. Lightweight computer paper could not ordinarily be properly re-fan-folded in the absence of the stiffeners because of its not being stiff enough to avoid bunching or rolling as it emerges at high speed from the computer printing equipment.

It has been found that the re-fan-folding of the paper emerging from high speed computer printers can be enhanced if at least certain of the sheet sections are not allowed to droop or bend downwardly as they are suspended from about by succeeding sheet sections and as they approach the stack of sheet sections in advance thereof. Thus, it is desirable that resistance to downward bending of the sheet sections be provided therefor to achieve optimum re-fan-folding.

Thus, the advantages of using relatively lightweight paper with stiffeners include the fact that this type of paper is less expensive than relatively heavier weight paper; the lightweight paper takes up less space in shipping cartons; a greater amount of lightweight paper can be accommodated in a shipping carton so that a greater supply of apper is available to increase the operating time of the computer printing equipment; and the lightweight paper requires less storage space than does relatively heavier weight paper. Fifteen pound computer paper, for example, as compared with twenty pound computer paper, reduces handling weight and shipping costs.

SUMMARY OF THE INVENTION

The above mentioned resistance to bending of the sheet sections can be provided by the aforesaid stiffeners if the stiffeners, after being applied to the paper in some suitable form, such as hot melt, are allowed to set to a solidified condition in a particular manner. It has been found that, if the face of the paper web to which the stiffener material is applied has a convex shape during the setting time of the material, the molecular pattern of the solidified material will itself have a curved configuration, thereby providing an inherent bias in the resulting stiffener which tends to urge the sheet section in one direction.

This invention is directed to the formation of this type of bias and provides a method and apparatus for applying one or more stiffeners to one face of a moving paper web, with each stiffener being applied to the paper in the form of a band of flowable, quick-setting material. The material is allowed to set to a solidified condition as the paper moves in synchronization on a curved or convex path. Thus, the molecular pattern of each stiffener will have a curved configuration tending to cause an inherent bias of the paper web in one direction for resisting any bending of the paper in the opposite direction. This bias will cause the paper web, when provided with spaced, transverse fold lines, to fall in re-fan-folded fashion from the exit of the computer printer toward and onto a stack in a much neater fashion than if the bias were not present in lightweight computer paper. Thus, the final stack will be immediately ready for removal rather than having to be manually re-shaped to place it in condition for removal.

The apparatus for carrying out the method of the present invention includes a rotatable cylinder or drum having a convex, outer surface, and means for guiding a flexible paper web toward, onto and off the drum so that one face of the paper web will assume a convex configuration during a portion of its path of travel. The apparatus further includes means for applying a flowable, quick-setting material to said one face in the form of one or more hands.

The flowable stiffening material can be applied to the paper web either immediately before or during the time that the paper web is movable about the drum so that the setting of the material to a solidified condition occurs as the paper web moves around the drum itself. The setting of the material will, therefore, provide a curved molecular pattern in the resulting stiffener providing a bias which tends to return the paper web to the curved condition it has when it was moving about the drum. When the paper web is provided with fold lines to define individual interconnected sheet sections, the sheet sections themselves will each have this bias. Thus, as the sheet sections approach a stack in a fan-folded or re-fan-folded fashion, the bias in each sheet section causes it to remain properly oriented with respect to those sheet sections which precede and follow the same so that the sheet sections will fall neatly onto the stack directly superimposed on all other sheet sections in advance thereof.

To apply the flowable stiffening material to the paper web, either applicator guns or applicator wheels can be used. In either case, stiffening material will preferably be supplied to the applicator means in the form of a hot melt. In one embodiment of the apparatus, the applicator means is adjacent to the arcuate path so that the hot melt material is applied to the paper web while the paper web is on the drum and in a convex condition. In another embodiment of the apparatus, the hot melt material is applied to a straight portion of the paper web at a location slightly spaced upstream from but in proximity to the drum, whereupon the paper web with the hot melt material applied to it moves immediately onto the drum where the hot melt material sets to a solidified condition on the drum itself.

The primary object of this invention is, therefore, to provide a method and apparatus for applying one or more stiffeners to one face of a moving paper web in a manner such that the stiffeners have an inherent bias by virtue of the molecular pattern of the same so that the bias provides a resistance to bending of the paper in a given direction to assure the proper re-fan-folding of the paper as it emerges at high speed from computer printing equipment.

Another object of this invention is to provide a method and apparatus of the type described wherein a paper web is moved around a convex path after a flowable, quick-setting material has been applied to one face thereof so that the material will set to a solidified condition while such face has a convex shape so that, when the paper is straightened out, it will have an inherent bias tending to cause it to assume a curved shape, thereby providing a resistance to bending in a given direction.

Other objects of this invention will become apparent as the following specification progresses, reference being had to the accompanying drawings for illustrations of several embodiments of the invention. In the drawings.

Figure 1:
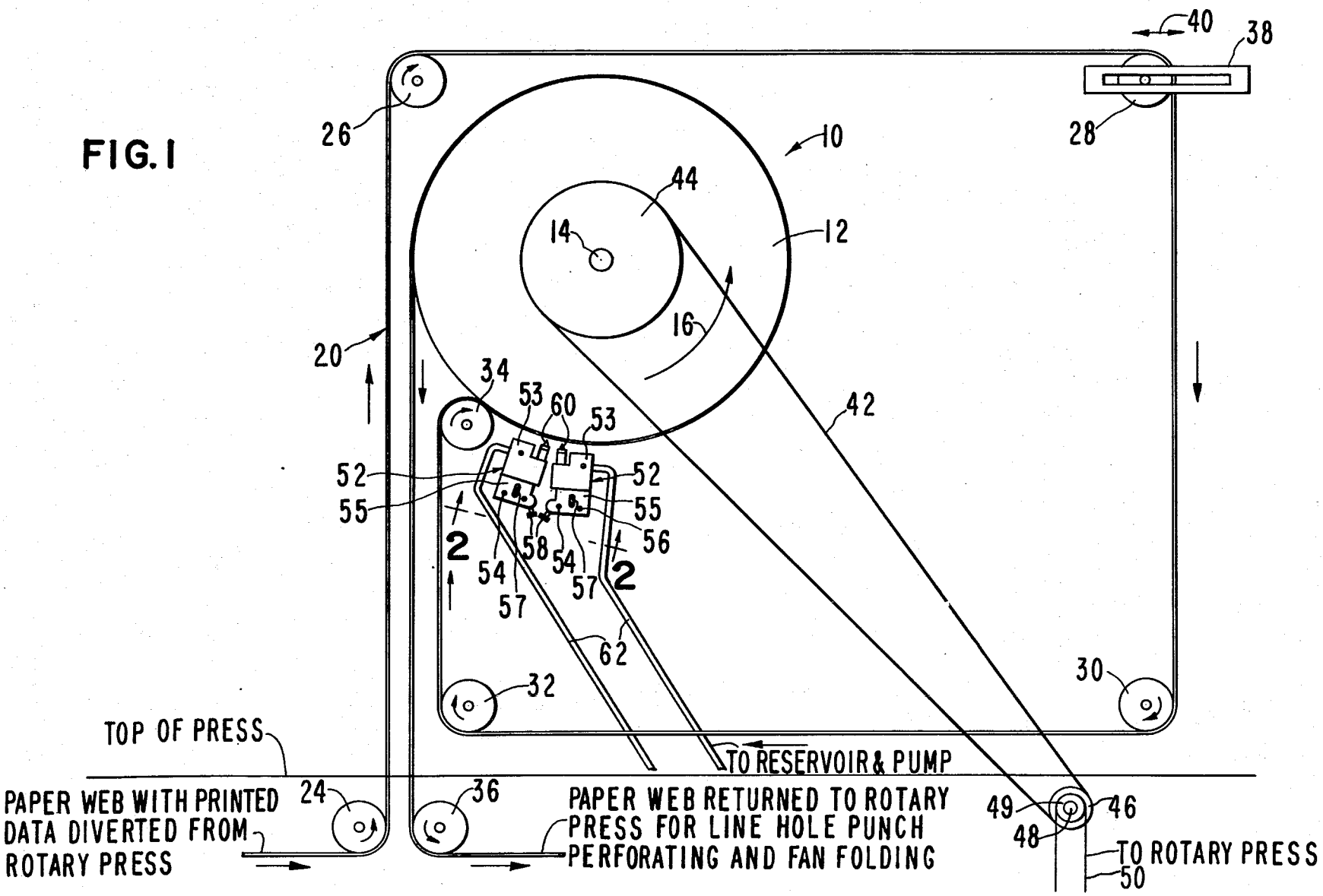
FIG. 1 is a side elevational view of one embodiment of the apparatus for carrying out the application of one or more stiffener bands to a moving paper web.

The first embodiment of the apparatus of this invention is broadly denoted by the numeral 10 and includes a cylinder or drum 12 having a convex outer surface and being mounted on a shaft 14 for rotation in the direction of arrow 16. Shaft 14 is mounted on suitable support structure (now shown) including a pair of spaced, fixed sides. The entire apparatus as shown is mounted on top of existing continuous rotary presses (not shown are mountings or presses) or could be build into a press.

Drum 12 is used as the backing member for a moving paper web 20 during the application and setting or curing of one or more bands of lines 18 (FIG. 3) of flowable quick-setting material on the normally rear face of paper web 20, the latter to be used as computer printout paper. Such bands or lines 18 provide stiffeners for the paper as disclosed in U.S. Pat. No. 3,658,364. Bands 18 have a finite width. For instance, each band could be in the range of 1/10 inch to 3/16 inch in width and about 1 mil. in thickness depending upon the desired degree of stiffness. Also, the bands could have different widths, if desired. The stiffener bands, when cured, are solidified and adhere to the paper web, thereby increasing its resistance to bending.

Figures 2, 3:
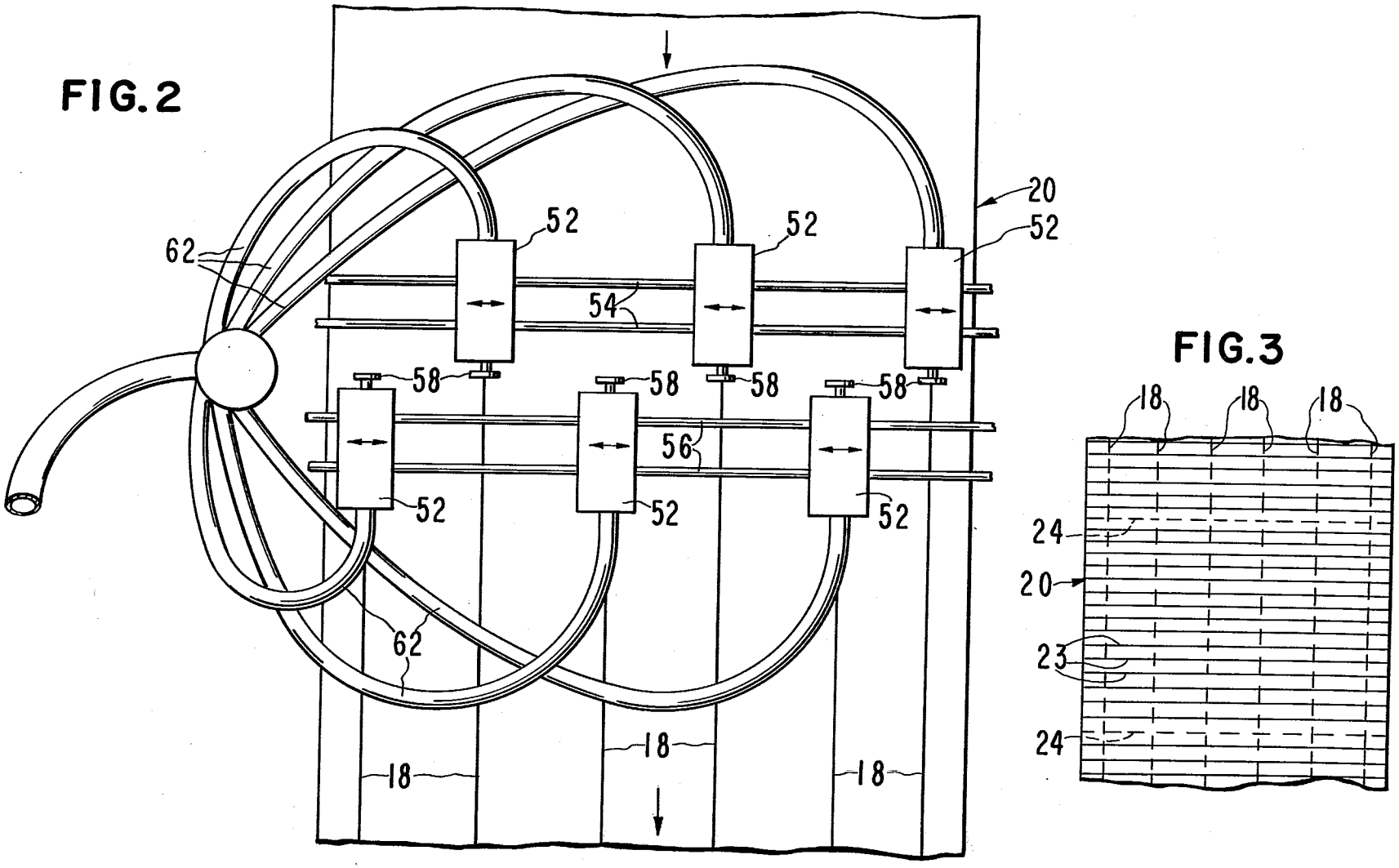
FIG. 2 is an enlarged, cross-sectional view taken along line 2—2 of FIG. 1.
FIG. 3 is a front elevational view of a segment of the paper web, showing a number of stiffener lines on the rear face thereof.

In the present invention, the curing or setting of the stiffener material occurs while the paper web is wrapped about drum 12. This provides a resistance to bending to facilitate the fan-folding of the paper web along transverse fold lines 24 formed thereon at spaced locations along the length thereof as shown in FIG. 3.

Apparatus 10 is preferably used with a rotary printing press 25 (top of press only being shown in FIG. 1) which operates to print data, such as transverse lines 23 on the normally front face of paper web 20. Other such data can include words, numbers and the like. Generally, the rotary press will be immediately upstream of apparatus 10 with reference to the direction of movement of paper web 20.

Apparatus 10 further includes a number of idler rollers for guiding the paper web 20 toward, partially about, and away from drum 12. These rollers are denoted by the numerals 24, 26, 28 30, 32, 34, and 36. The rollers are all rotatable about respective parallel shafts carried on the support structure to which shaft 14 is mounted. Roller 28 is provided with an adjustable strap 38 to permit it to be shifted either back or forth in the direction of arrow 40 to synchronize the printed image on the paper web with the press length of the rotary press with which apparatus 10 is associated.

Drum 12 is rotated in any suitable manner under the influence of the drive means of the rotary press. For purposes of illustration, drum 12 is driven by an endless, flexible timing belt or chain 42 coupled to a sprocket 44 rigid to one end of shaft 14 to wheel drum 12 is rigidly coupled. Chain 42 is also coupled to a second sprocket 46 rigid to a general synchronizing shaft 48 to which a second sprocket 49 is rigidly coupled. An endless, flexible timing belt or chain 50 is rigidly coupled to sprocket 49. Chain 50 drives supply pumps from shaft 48, the latter forming a part of the rotary press so that the rotation of drum 12 is synchronized with the operation of the rotary press itself. Other types of drive means can be provided in drum 12, if desired.

Means for applying the stiffener bands to paper web 20 includes a plurality of spaced applicator guns 52 disposed adjacent to drum 12 downstream of roller 34, the location at which paper web 20 moves onto the drum. As shown in FIG. 2, two banks of applicator guns 52 are provided, one bank being shiftably mounted on a first pair of spaced bars 54 for axial movement relative thereto, and a second bank being shiftably mounted on a second pair of spaced bars 56 for axial movement relative to the latter. Bars 54 and 56 are coupled in any suitable manner to the support structure to which shaft 14 is coupled. Applicator guns 52 of the first bank 54 are staggered with respect to the applicator guns 52 of the second bank 56 to permit adjustment of the same widthwise of paper web 20 if variations in the spacing between the applicator guns are desired. As shown, the stiffener bands applied with the applicator guns are parallel with each other and some are equally spaced from each other. However, such bands do not need to be equally spaced but can be of any spacing as desired.

Each applicator gun 52 has a set screw 58 or the like to anchor the same in a fixed position along the corresponding pair of mounting bars 54 or 56. In addition, each applicator gun has means permitting it to move toward and away from prper web 20 so that one or more applicator guns 52 may be rendered inoperable if fewer stiffener bands 18 are desired. Thus, each applicator gun is movable in two degrees of freedom, namely, widthwise of the paper web and toward and away from the latter.

For purposes of illustration, each applicator gun 52 has two relatively shiftable parts 53 and 55 (FIG. 1). Part 55 has a pair of sides provided with respective slots 57 (only one of which is shown in FIG. 1), and part 53 is received between such sides. A fastener carried by part 53 for each slot 57, respectively, passes through the corresponding slot and, when tightened, releasably secures part 53 in a fixed position relative to part 55, the latter being coupled to the corresponding mounting bars.

In the alternative, each pair of mounting bars 54 or 56 can be mounted so that they move toward and away from the paper web 20. Also an applicator gun 52 could be rendered inoperative by stopping the flow of hot melt material thereto, such as by a valve.

Each gun has a tip 60 (FIG. 1) for applying the flowable material to the paper web to form a corresponding stiffener band. The material is in the form of a quick-setting hot melt supplied to each applicator gun by respective tube 62 which extends away from the gun 52 and is connected to a source of the hot melt, such as a pump synchronized to press speed and a hot melt reservoir.

The hot melt material may or may not be repulpable. A non-repulpable material can be obtained from Swift Chemical Company, Chicago, Ill., designated by the code Z 12-242. If a repulpable material is desired, a suitable product for this purpose is one designated by the code 76-7808 made and sold by National Starch and Chemical Company, San Francisco, California.

The hot melt applicatory system further comprises one or more hot melt tanks, tank heaters, externally heated hoses, and thermostat control units. These components can be obtained individually or as a system from a number of manufacturers including Nordson Corporation, Amherst, Ohio, and L.T.I. Corporation of Sand City, Calif.

The number of applicator guns used to apply the hot melt material to paper web 20 would, of course, depend upon the width of the paper web and the weight of the paper of the web itself.

The pump which supplies the hot melt material to the applicator guns is gear-driven in synchronization with the drive means of the rotary press by timing chain 50 from shaft 48. Thus, the rotary press is the parent machine which determines the spaced of drum 12 and the volume rate of flow of hot melt material to the applicator guns.

To utilize apparatus 10, it will generally be located on top of an existing rotary press or incorporated in a rotary press. The apparatus is sufficiently flexible to permit it to be used with different types of rotary presses, such as a Kidder press, a Hamilton press and a Miehle press, all of which are well-known in the art. Generally, the diameter of the drum will be selected to assure substantial setting of a particular hot melt material on the drum for a particular speed of travel of the paper web 20 before web 20 moves off the drum and returns to the rotary press. Once it is returned to the rotary press from apparatus 10, the paper web will move through stations including a line-hole punching station, a station at which fold lines 24 are formed in the paper web, and a fan-folding station at which the paper web is fan-folded along the fold lines into a neat stack.

In operation, paper web 20 is fed over the various idler rollers 24, 26, 28, 30, 32, 34 and 36 and about drum 12. When the paper web commences to move at the normal operating speed of the rotary press, hot melt material flows into guns 52, assuming all six guns are in operation, and tips 60 apply the hot melt material to the back face of paper web 20 as the web is wound on drum 12. Since the hot melt material is quick-setting, the setting or curing occurs while the hot melt portion is on the convex, outer periphery of the drum. Thus, the setting or curing will automatically develop a built-in bias in the paper web due to the presence of the resulting stiffener bands so that there will be a tendency for the individual sheet sections of the paper web defined in the fold lines 24 to resist bending when the sheet sections are fan-folded into a neat stack after issuing from the rotary press or a high speed printer.

The foregoing operation may be conducted if one or more applicator guns 52 are initially rendered inoperable. The distance through which paper web 20 travels after leaving the rotary press and traveling through apparatus 10 before returning to the rotary press must be in exact multiples of normal press lengths. Such lengths include 8½inches, 10 inches, 11 inches, 12 inches, 14 inches, etc.

While applicator guns have been described as applying the hot melt material to the paper web, it is clear that other means can be provided for doing this same purpose. For instance, applicator wheels of the type shown in FIG. 4 and described hereinafter can be used instead of applicator guns in apparatus 10.

Figure 4:
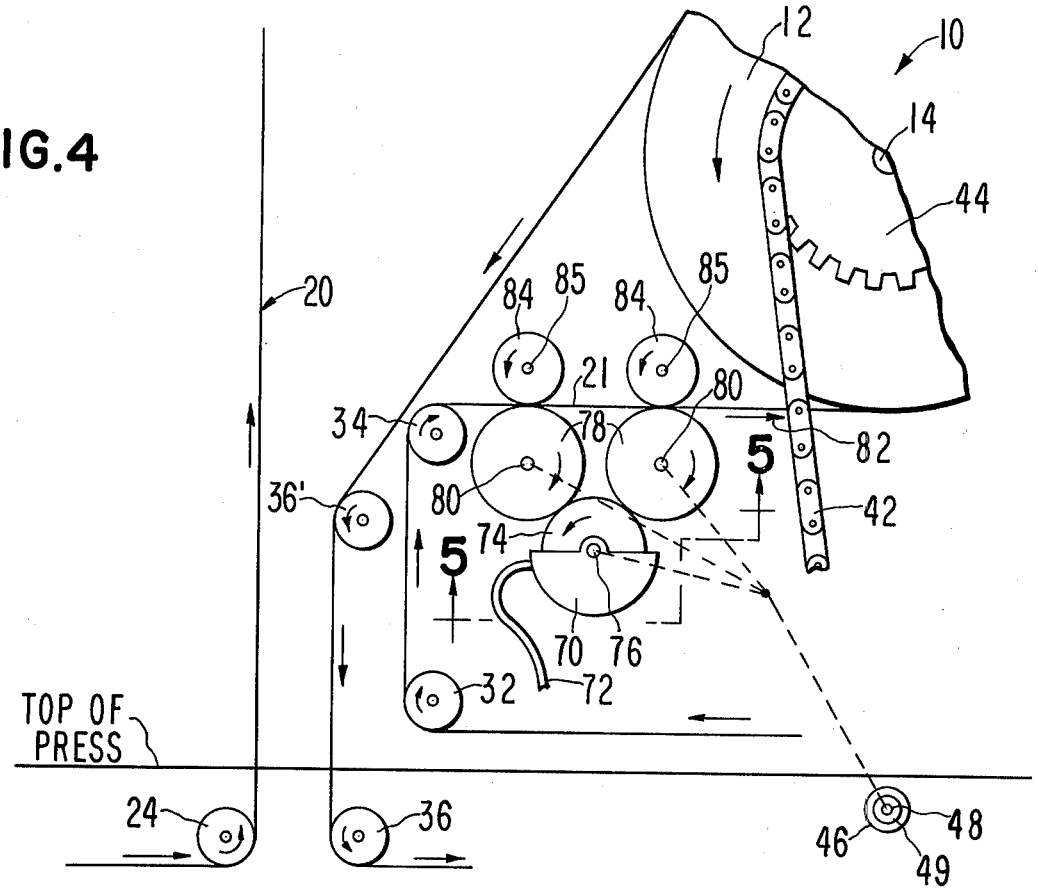
FIG. 4 is an enlarged, fragmentary view similar to FIG. 1 but illustrating a second embodiment of the apparatus.
Figure 5:
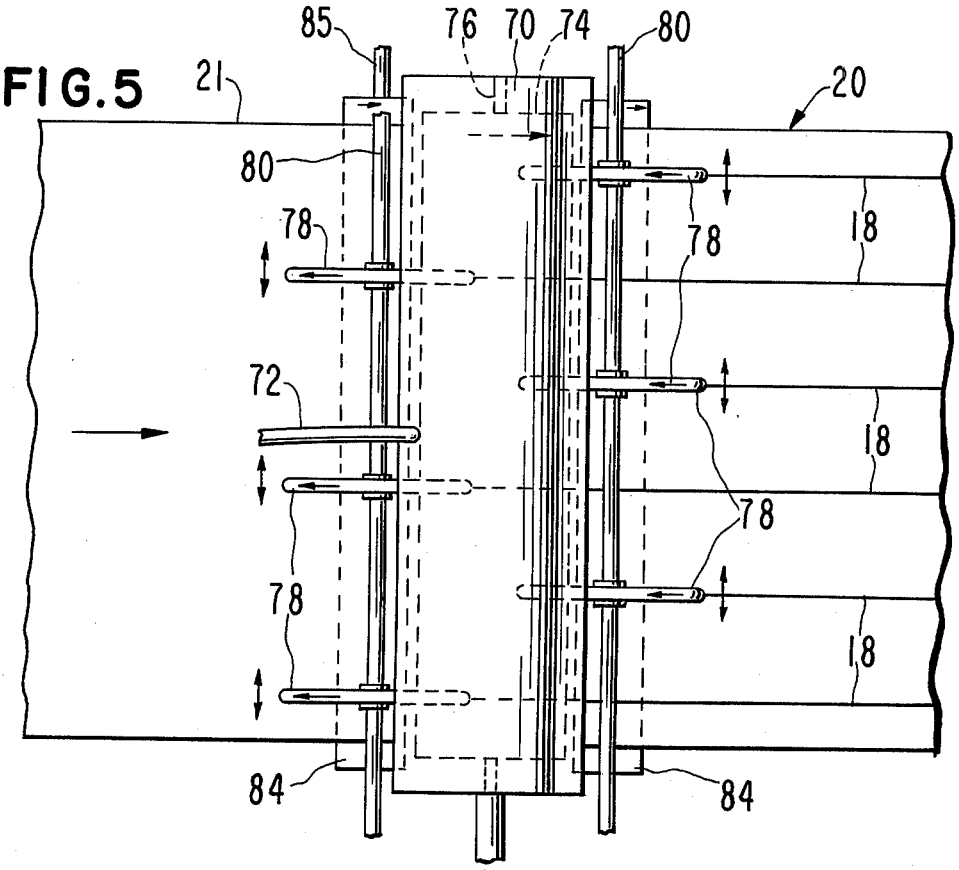
FIG. 5 is a bottom plan view of a part of the apparatus of FIG. 4, looking in the direction of line 5-5 of FIG. 4.

FIG. 4 illustrates a second embodiment of the hot melt application means for apparatus 10, such applicator means being spaced upstream of the location at which the paper web moves onto the drum. To this end, the hot melt material is applied to the paper web on a substantially horizontal portion of paper web 20 thereof immediately before the paper web is partially wrapped about the drum.

The hot melt applicator means includes an open top reservoir 70 which receives a hot melt material by means of a tube 72 from a hot melt pump synchronized by press speed. A cylinder 74 mounted on a shaft 76 rotates in reservoir 70 and engages a plurality of wheels 78 mounted on respective shafts 80 parallel with shaft 76 and shaft 14 of drum 12. Wheels 78 have outer peripheries adapted to engage the underside of horizontal portion 21 of paper web 20 as the latter moves in the direction of arrow 82. Backing wheels 84 are provided for respective wheels 78 and are mounted for rotation by respective shafts 85 so that paper web portion 21 passes between each wheel 78 and its corresponding back-up wheel 84 whereby the hot melt material is readily applied to the paper web between the wheels. Immediately after application of the hot melt material, the paper web moves onto the convex, outer periphery of drum 12 where the setting of the hot melt material occurs. Since the material is a quick-setting type, it will have set by the time the paper web moves off drum 12.

Timing chains or belts (denoted by dashed lines in FIG. 4) couple shaft 48 of the rotary press to shafts 76 and 80 of cylinder 74 and wheels 78, respectively. Thus, cylinder 74 and wheels 78 will be controlled by the press speed so that, as the printing press slows down or speeds up, wheels 78 and cylinder 74 also slow down or speed up in corresponding fashion. This assures that the paper web will not be adversely affected due to a variation in the speed of wheels 78 and the speed of the paper web moving past the same.

I claim:

1. A method of applying a band of flowable stiffening material to one face of a flexible web of computer paper and moving said web about a major portion of a cylindrical surface, said stiffening material being applied to said moving web at a location near the point at which the web commences to move about said cylindrical surface with the stiffening material being capable of setting to a solidified condition, said materials being cured when the web is on said cylindrical surface to cause the material to set to said solidified condition to develop a built-in bias in the web whereby a relatively lightweight web of computer paper can be stiffened sufficiently to perform as effectively in a computer printout system as a relatively heavier weight paper.

2. A method as set forth in claim 1; wherein said stiffening material is applied to the web before it moves about said cylindrical surface.

3. A method as set forth in claim 1, wherein said stiffening material is in the form of a hot melt and is extruded onto said paper web.

4. A method as set forth in claim 1, wherein said stiffening material is in the form of a hot melt and is rolled onto said paper web.

5. A method as set forth in claim 1, wherein is included the step of rotating said surface as the web moves about it.

6. A method as set forth in claim 1, wherein said stiffening material is applied to the web after it moves onto said cylindrical surface.

* * * * *